US005236660A

United States Patent [19]

Reynaud et al.

[11] Patent Number: 5,236,660

[45] Date of Patent: Aug. 17, 1993

[54] HEAT-RESISTANT VERMICULAR OR SPHEROIDAL GRAPHITE CAST IRON

[75] Inventors: Alain Reynaud, Meudon; Jean-Luc Roberge, Fontenay Le Fleury, both of France

[73] Assignee: Centre Technique des Industries de la Fonderie, France

[21] Appl. No.: 948,572

[22] Filed: Sep. 23, 1992

[30] Foreign Application Priority Data

Sep. 26, 1991 [FR] France ..... 91 11875

[51] Int. Cl.[5] ..... C22C 37/00; C22C 37/04

[52] U.S. Cl. ..... 420/28; 148/321

[58] Field of Search ..... 420/28, 9; 148/321

[56] References Cited

U.S. PATENT DOCUMENTS 2,885,285 5/1959 Dickinson ..... 420/28

FOREIGN PATENT DOCUMENTS 869494 3/1953 Fed. Rep. of Germany .
241682 8/1969 U.S.S.R. .
323076 12/1929 United Kingdom .

*Primary Examiner*—Deborah Yee
*Attorney, Agent, or Firm*—Bacon & Thomas

[57] ABSTRACT

The invention relates to heat resistant vermicular or spheroidal graphite cast iron. To make cast iron resistant to temperatures of 900° C. to more than 1000° C. while reducing manufacturing costs, the cast iron includes 4.7% to 7.1% by weight of Si equivalent, where $Si_{eq}$ is defined as Si+0.8Al, and in which the concentration by weight of Si lies in the range 3.9% to 5.3% and the concentration of Al lies in the range 0.5% to 2.5%.

12 Claims, No Drawings

HEAT-RESISTANT VERMICULAR OR SPHEROIDAL GRAPHITE CAST IRON

The present invention relates to heat-resistant vermicular or spheroidal graphite cast iron.

More precisely, the invention relates to vermicular or spheroidal graphite cast iron having high resistance to oxidation and which presents high mechanical qualities at temperatures running typically from 900° C. to more than 1000° C.

BACKGROUND OF THE INVENTION

Developments in certain techniques make it necessary to have available cast irons, or more generally materials, that are capable, in particular, of retaining their mechanical qualities and their qualities of resistance to oxidation at higher and higher temperatures, in particular temperatures greater than 900° C.

This applies in particular to the automobile industry where the increase in performance of vehicle engines gives rise to increasingly severe conditions, and in particular temperature conditions, that the components of the engines must be capable of withstanding. In particular, certain parts of engines such as exhaust manifolds and turbine housings are subjected to ever increasing thermal and mechanical stresses, be they maximum temperatures, temperature gradients, thermal shocks, mechanical stresses, creep when hot, or thermal fatigue.

At present, the cast irons available for such temperature ranges are austenitic cast irons having a high nickel content. Typically the nickel content lies in the range 20% to 35% by weight for temperatures greater than 900° C. For temperatures greater than 1000° C., it is also necessary to add silicon. The drawback with such cast irons is that they make use of large quantities of nickel. Nickel has the drawback both of being expensive and also of being considered as a strategic material, and thus of suffering from very large fluctuations in price.

In addition, it is known that in motor manufacture, economic constraints relating to competition are becoming more and more acute and it is therefore particularly advantageous to be able to use materials of low cost while nevertheless capable of satisfying severe conditions of use.

An object of the present invention is to provide a cast iron having properties of mechanical strength and of resistance to oxidation that are at least as good as those of known cast irons for high temperature (typically greater than 900° C.), but that have manufacturing costs which are lower than known spheroidal graphite cast irons having a high nickel content.

In the present specification, the term "cast iron" should be understood as designating an alloy containing at least 85% iron.

SUMMARY OF THE INVENTION

According to the invention, this object is achieved by heat-resistant vermicular or spheroidal graphite cast iron comprising 4.7% to 7.1% by weight Si equivalent ($Si_{eq}$), where $Si_{eq}$ is defined as Si+0.8Al, and in which the concentration by weight of Si lies in the range 3.9% to 5.3% and the concentration of Al lies in the range 0.5% to 2.5%.

In a preferred implementation, the cast iron also includes 0.5% to 1.5% molybdenum.

In another preferred implementation, the spherical graphite cast iron further includes 0.5% to 1.5% cobalt and/or 0.5% to 1.5% niobium.

Given the composition of this cast iron of the invention, the graphite will be spheroidal and/or vermicular depending on the massiveness of the pieces made from it.

Such a cast iron has properties of mechanical strength and of resistance to oxidation that are at least equivalent to those obtained with known nickel-based spheroidal graphite cast irons. It will nevertheless be understood that insofar as they are made without nickel but with silicon or aluminum, they are significantly cheaper, and manufacture thereof is not dependent on obtaining supplies of a basic material that is considered as being strategic.

Other characteristics and advantages of the invention appear more clearly on reading the following description of several implementations of the invention given by way of non-limiting example.

DETAILED DESCRIPTION

As already mentioned, the invention is based on controlling the silicon equivalent content of the cast iron. Silicon equivalent is defined by the relationship $Si_{eq}$=-Si+0.8Al. This definition has been determined empirically. The numerical coefficient for the aluminum (0.8) is selected by an iterative calculation such that the AC1 point is an increasing linear function of the "silicon-equivalent". This expression as confirmed by experiment, makes it possible to observe that the contribution of aluminum to what might be called the "refractiveness" of the cast iron is equal to about 80% of the contribution of silicon. Depending on the operating or utilization temperature of a piece made of cast iron, its silicon equivalent content is as follows:

| | |
|---|---|
| 900° C. to 950° C.: | 4.7% to 6%; |
| 950° C. to 1000° C.: | 6% to 6.7%; |
| greater than 1000° C.: | greater than 6.7%. |

Nevertheless, the maximum content of silicon equivalent cannot exceed 7.1% without the cast iron becoming too brittle.

In addition, within the above-mentioned ranges, the total silicon content lies in the range 3.9% to 5.3%, and the aluminum content lies between 0.5% and 2.5% by weight. Tests have shown that the best results are obtained when the aluminum content by weight lies in the range 1.6% to 2.2%.

It will be understood that the presence of aluminum reinforces the action of silicon on the structural stability of the cast iron and on the ability of the resulting material to avoid oxidation. In particular, it will be understood that by limiting the silicon content, the undesirable effects of too great a quantity of silicon are avoided, in particular giving rise to an alloy that is brittle at ambient temperature.

In addition, depending on the intended utilization of the cast iron, and thus depending on certain special characteristics that is might be desirable to obtain in the cast iron, various other alloy elements may be added, in particular molybdenum, cobalt, or niobium at concentrations lying in the range 0.5% to 1.5%. It should also be specified that the carbon content is such that the concentration by weight of carbon equivalent is of the order of 4.3% to 4.8%.

It is known that carbon equivalent is defined by the pure carbon content plus one-third the silicon content plus the aluminum content multiplied by a coefficient of 0.16. It can thus be seen that the carbon content is adjusted as a function of the silicon content selected in the manner explained above.

In a particular example of a cast iron of the invention, it has the following composition: silicon 4.3%, aluminum 2.2%, molybdenum 1%, cobalt 1%, niobium 1%, and carbon 3.1%.

Tests, in particular resistance to oxidation, have been performed on spheroidal cast irons of the invention, and in particular on the cast iron having the composition given in the above example, and those tests show that utilization properties are at least equal, if not better than those obtained with grades of austenitic spheroidal graphite cast iron having a high nickel content. In particular, with the above-mentioned concentrations of silicon and of aluminum, the oxideability of the cast iron is considerably reduced and the alloy continues to be ferritic up to high temperatures, typically temperatures greater than 1000° C. Finally, adding small concentrations of molybdenum, of cobalt, or of niobium as a function of the intended utilizations makes it possible to increase mechanical properties when hot compared with those of usual grades, in particular with respect to creep when hot.

The accompanying table serves to compare the properties of four cast iron compositions in accordance with the invention with a known cast iron composition comprising 35.35% nickel, 3.05% chromium, and 3.1% silicon.

It can be seen that cast irons of the invention have mechanical properties that are greater than or equal to those of the nickel cast iron and that their properties of resistance to oxidation are substantially improved. For the cast iron having 4.45% silicon and 1.65% aluminum, properties of resistance to oxidation are maintained but mechanical properties are very substantially improved. For cast irons having an aluminum concentration equal to or greater than 1.8%, properties of resistance to oxidation are considerably improved.

Cast irons of the invention can be fabricated using the techniques presently implemented in the art. It is merely necessary to add the aluminum as late as possible, which does not give rise to any special problems given its low melting point temperature of about 800° C.

The proposed material should be fabricated using techniques that limit as much as possible any entrainment of non-metallic inclusions in the pieces made. In addition to particularly careful cleaning, it may be necessary to use filtering and inerting methods.

The inoculation of the liquid metal should be sufficiently powerful, particularly when making thin pieces. When necessary, that can be done by post-inoculation in the casting mold.

TABLE

| Cast iron composition | 4.45% Si 1.15% Mo 1.65% Al | 4.3% Si 1.1% Mo 2% Al | 5.2% Si 1.11% Mo 2.05% Al | 5.1% Si 1% Mo 0.7% Nb 2.05% Al | 35.35% Ni 3.05% Cr 3.1% Si |
|---|---|---|---|---|---|
| Traction strength at ambient temperature UTS in MPa | 634 | 545 | 436 | 424 | 445 |
| Oxide thickness after 50 hours at 800° C. in mm | 0.01–0.33 | 0 | 0 | 0 | 0.15–0.2 |
| Oxide thickness after 50 hours at 900° C. in mm | 0–0.24 | 0 | 0 | 0 | 0.1–0.25 |
| Oxide thickness after 50 hours at 950° C. in mm | 0.05–0.5 | 0 | 0 | 0 | 0.17–0.3 |

We claim:

1. Heat-resistant vermicular or spheroidal graphite cast iron comprising 4.7% to 7.1% by weight Si equivalent, where $Si_{eq}$ is defined as Si+0.8Al, and in which the concentration by weight of Si lies in the range 3.9% to 5.3%, and the concentration of Al lies in the range 0.5% to 2.5%.

2. Vermicular or spheroidal graphite cast iron according to claim 1, in which the concentration by weight of aluminum lies in the range 1.6% to 2.2%.

3. Vermicular or spheroidal graphite cast iron according to claim 1, further including 0.5% to 1.5% by weight of Co.

4. Vermicular or spheroidal graphite cast iron according to claim 1, further including 0.5% to 1.5% by weight of Nb.

5. Vermicular or spheroidal graphite cast iron according to claim 1, further including 0.5% to 1.5% by weight of Mo.

6. Vermicular or spheroidal graphite cast iron according to claim 1, in which the equivalent carbon content is of the order of 4.5% to 4.8% by weight, where $C_{eq}$ is defined as: C+0.33 Si+0.16Al.

7. Vermicular or spheroidal graphite cast iron according to claim 2, further including 0.5% to 1.5% by weight of Co.

8. Vermicular or spheroidal graphite cast iron according to claim 2, further including 0.5% to 1.5% by weight of Nb.

9. Vermicular or spheroidal graphite cast iron according to claim 2, further including 0.5% to 1.5% by weight of Mo.

10. Vermicular or spheroidal graphite cast iron according to claim 2, in which the equivalent carbon content is of the order of 4.5% to 4.8% by weight, where $C_{eq}$ is defined as: C+0.33 Si+0.16Al.

11. Vermicular or spheroidal graphite cast iron according to claim 6, further including 0.5% to 1.5% by weight of a metal selected from the group comprising: Co, Nb, and Mo.

12. A vermicular or spheroidal graphite cast iron whose composition by weight consists essentially in: 4.9% silicon, 2.2% aluminum, 1% molybdenum, 1 cobalt, 1% niobium, and 3.1% carbon, the remainder being essentially iron.

* * * * *